United States Patent [19]

Guth et al.

[11] Patent Number: 5,002,686

[45] Date of Patent: Mar. 26, 1991

[54] AQUEOUS, HARD WATER-RESISTANT WETTING AGENT AND DETERGENT COMPOSITION, AND THE PREPARATION AND USE THEREOF IN TEXTILE PRETREATMENT

[75] Inventors: Christian Guth, Birsfelden, Switzerland; Albert Stehlin, Rosenau, France

[73] Assignee: Ciba-Geigy Corporation, Ardsley, N.Y.

[21] Appl. No.: 399,204

[22] Filed: Aug. 28, 1989

[30] Foreign Application Priority Data

Sep. 1, 1988 [CH] Switzerland ..... 3264/88

[51] Int. Cl.[5] ..... C11D 3/36; C11D 3/37

[52] U.S. Cl. ..... 252/174.16; 252/173; 252/174.21; 252/174.23; 252/DIG. 1; 252/DIG. 2; 252/DIG. 17

[58] Field of Search ..... 252/174.16, DIG. 17

[56] References Cited

U.S. PATENT DOCUMENTS

| | | | |
|---|---|---|---|
| 3,536,628 | 10/1970 | Lancashire | 252/117 |
| 4,254,063 | 3/1981 | Becker | 260/931 |
| 4,612,352 | 9/1986 | Schäfer et al. | 525/404 |
| 4,861,342 | 8/1989 | Danel | 8/444 |

FOREIGN PATENT DOCUMENTS

| | | |
|---|---|---|
| 0295205 | 5/1988 | European Pat. Off. . |
| 2027048 | 2/1980 | United Kingdom . |

*Primary Examiner*—A. Lionel Clingman
*Assistant Examiner*—A. Beadles-Hay
*Attorney, Agent, or Firm*—George R. Dohmann; Edward McC. Roberts

[57] ABSTRACT

Aqueous, hard water-resistant wetting agent and detergent compositions comprising (a) a mixture of monomeric and oligomeric phosphoric acid esters, (b) a water-soluble or water-dispersible copolymer, (c) a nonionic surfactant, (d) an alkali metal hydroxide and optionally (e) an antifoam. These compositions can be used as wetting agents and detergents in textile pretreatment.

12 Claims, No Drawings

AQUEOUS, HARD WATER-RESISTANT WETTING AGENT AND DETERGENT COMPOSITION, AND THE PREPARATION AND USE THEREOF IN TEXTILE PRETREATMENT

The present invention relates to a novel aqueous, hard water-resistant wetting agent and detergent composition and to the preparation and use thereof in textile pretreatment.

The hard water-resistant wetting agent and detergent composition of this invention comprises (a) a mixture of monomers and oligomers of formula

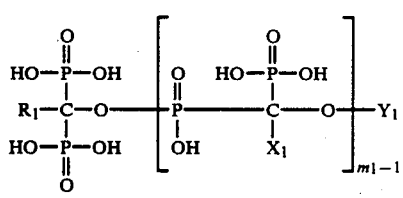

(1)

wherein $Y_1$ is hydrogen or —CO—$T_1$, $R_1$, $X_1$ and $T_1$ are each $C_1$–$C_4$ alkyl, and $m_1$ is an integer from 1 to 17, (b) a water-soluble or water-dispersible copolymer which contains not less than 20% by weight, based on said copolymer, of a hydrophilic component which is attached to a carbon atom and at least one hydrophobic radical which is attached through a polyglycol ether chain to the hydrophilic component, which polyglycol ether chain contains 2 to 200

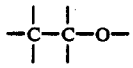

groups, (c) a nonionic surfactant, (d) an alkali metal hydroxide, and optionally (e) an antifoam.

Component (a) of this invention is mixture of water-soluble monomers and oligomers of formula (1) which are preferably in the form of alkali metal salts, more particularly sodium salts and, most preferably, potassium salts.

Preferred mixtures of monomers and oligomers which are used as component (a) of the composition of this invention are in particular those of formula

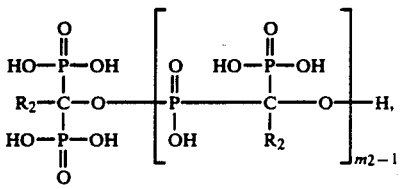

(2)

wherein $R_2$ is methyl or ethyl and $m_2$ is 1 to 13.

The monomer unit of the mixture of monomers and oligomers of formula (1) has the general formula

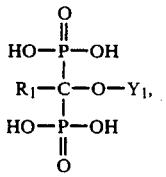

(3)

wherein $Y_1$ is hydrogen or —CO—$T_1$ and $R_1$ and $T_1$ are each independently of the other $C_1$–$C_4$ alkyl.

A particularly preferred monomer is that of formula

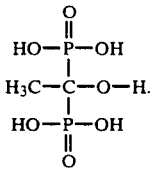

(4)

The compounds suitable for use as component (b) are water-soluble graft polymers which, on the one hand, contain a main chain consisting of an anionic, cationic, amphoteric or, preferably, nonionic alkylene oxide polyadduct which carries a hydrophobic radical and, on the other, side chains of structural units grafted on to individual carbon atoms of said main chain, which structural units are derived from ethylenically unsaturated polymerisable monomers which contain hydrophilic groups, for example monomeric sulfonic acids or, preferably, carboxylic acids or the anhydrides thereof.

The monomers required for introducing the side chains may be used singly or in admixture with one another.

Preferred graft polymers of this invention have a main chain consisting of at least one nonionic alkylene oxide polyadduct which carries a hydrophobic radical and whose second terminal hydroxyl group is unsubstituted. These nonionic surfactants are preferably polyadducts of 2 to 200 mol of alkylene oxide, for example ethylene oxide and/or propylene oxide, with 1 mol of an aliphatic monoalcohol containing not less than 8 carbon atoms, of a trihydric to hexahydric aliphatic alcohol or of a $C_8$–$C_{22}$ fatty acid. The trihydric to hexahydric alkanols contain 3 to 6 carbon atoms and are, in particular, glycerol, trimethylolpropane, erythritol, mannitol, pentaerythritol and sorbitol.

Aliphatic monoalcohols for the preparation of the nonionic surfactants are, for example, water-insoluble monoalcohols containing not less than 8 carbon atoms, preferably from 12 to 22 carbon atoms. These alcohols may be saturated or unsaturated and branched or straight chain, and may be used singly or in admixture. Alcohols which may be reacted with the alkylene oxide are, for example, natural alcohols such as myristyl alcohol, cetyl alcohol, stearyl alcohol or oleyl alcohol, or synthetic alcohols, for example oxoalcohols such as preferably 2-ethylhexanol, and also trimethyl hexanol, trimethylnonyl alcohol, hexadecyl alcohol or linear primary alcohols containing on average (8 to 10), (10 to 14), (12), (16), (18), or (20 to 22) carbon atoms.

The fatty acids preferably contain from 8 to 12 carbon atoms and may be saturated or unsaturated, and are, for example, capric acid, lauric acid, myristic acid, palmitic acid or stearic acid, or decenoic acid, dodecenoic acid, tetradecenoic acid, hexadecenoic acid, oleic acid, linoleic acid, linolenic acid or, preferably, ricinolic acid.

Ethylenically unsaturated polymerisable carboxylic acids or sufonic acids which may be suitably used for introducing the grafted monomers (side chains) into the alkylene oxide polyadducts which constitute the main chain may be monocarboxylic acids as well as dicarboxylic acids and the anhydrides thereof and also sulfonic acids, each containing an ethylenically unsaturated aliphatic radical and preferably not more than 7 carbon atoms. The monocarboxylic acids are for example acrylic acid, methacrylic acid, β-haloacrylic acid, 2-hydroxyethylacrylic acid, β-cyanoacrylic acid, crotonic acid and vinylacetic acid. Preferred ethylenically unsaturated dicarboxylic acids are fumaric acid, maleic acid or itaconic acid, and also mesaconic acid, citraconic acid, glutaconic acid and methylenemalonic acid. The preferred anhydride of these acids is maleic anhydride.

Examples of suitable sulfonic acids are vinylsulfonic acid or 2-acrylamido-2-methylpropanesulfonic acid. It is preferred to use monocarboxylic acids of 3 to 5 carbon atoms, more particularly methacrylic acid, and, most preferably, acrylic acid.

Particularly interesting graft polymers contain, as main chain, radicals of a polyadduct of 2 to 40 mol of ethylene oxide with 1 mol of a $C_{12}$–$C_{22}$-fatty alcohol and, as side chains, not less than 30% by weight, preferably not less than 50% by weight, based on said graft polymer, of grafted acrylic acid.

The preparation of the graft polymers is carried out by methods which are known per se, for example those described in European patent application 0 098 803.

Exemplary of nonionic alkylene oxide polyadducts which are used as main chain of component (a) are the following products:

$A_1$ the polyadduct of 6 mol of ethylene oxide with 1 mol of 2-ethylhexanol, $A_2$ the polyadduct of 5 mol of ethylene oxide with 1 mol of 2-ethylhexanol, $A_3$ the polyadduct of 15 mol of ethylene oxide with 1 mol of stearyl alcohol, $A_4$ the polyadduct of 3 mol of ethylene oxide with 1 mol of alfol (8-10), $A_5$ the polyadduct of 5 mol of ethylene oxide with 1 mol of hexadecyl alcohol, $A_6$ the polyadduct of 18 mol of ethylene oxide with 1 mol of oleyl alcohol, $A_7$ the polyadduct of 12 mol of ethylene oxide with 1 mol of oleic acid, $A_8$ the polyadduct of 5 mol of ethylene oxide with 5 mol of propylene oxide and 1 mol of alfol (12-14), $A_9$ the polyadduct of 7 mol of ethylene oxide with 1 mol of $C_9$–$C_{13}$ oxoalcohol.

In addition to the nonionic surfactants mentioned above, compounds suitable for use as component (c) are nonionic polyadducts of 2 to 200 mol of alkylene oxide, for example, ethylene oxide and/or propylene oxide, with 1 mol of a phenol or of an alkyl- or phenyl-substituted phenol or of a $C_8$–$C_{22}$ fatty acid. Monoalcohols of 8 to 22 carbon atoms are preferred.

Examples of unsubstituted or substituted phenols are phenol, o-phenylphenol or alkylphenols which contain 1 to 16, preferably 4 to 12, carbon atoms in the alkyl moiety. Examples of these alkylphenols are: p-cresol, butylphenol, tributylphenol, octylphenol and, most preferably, nonylphenol.

Typical examples of nonionic surfactants are:

polyadducts of preferably 1 to 30 mol of alkylene oxide, preferably ethylene oxide, in which individual ethylene oxide units may be replaced by substituted epoxides such as styrene oxide and/or propylene oxide, with higher unsaturated or saturated fatty alcohols, fatty acids, fatty amines or fatty amides of 8 to 22 carbon atoms, or with phenylphenol or alkylphenols whose alkyl moieties contain not less than 4 carbon atoms;

condensates of alkylene oxide, preferably of ethylene oxide and/or propylene oxide;

reaction products of a $C_8$–$C_{22}$ fatty acid and a primary or secondary amine containing at least one hydroxy-lower alkyl group or lower alkoxy-lower alkyl group, or adducts of alkylene oxide with said hydroxyalkylated reaction products, the reaction being carried out such that the ratio of hydroxyalkylamine to fatty acid may be 1:1 or greater than 1, for example 1:1 to 2:1; and polyadducts of propylene oxide with a trihydric to hexahydric aliphatic alcohol of 3 to 6 carbon atoms, for example glycerol or pentaerythritol, which polypropylene oxide adducts have an average molecular weight of 250 to 1800, preferably 400 to 900; and esters of polyalcohols, especially mono- or diglycerides of $C_{12}$–$C_{18}$-fatty acids, for example monoglycerides of lauric, stearic or oleic acid.

Very suitable nonionic surfactants are polyadducts of 2 to 15 mol of ethylene oxide with 1 mol of $C_8$–$C_{22}$ fatty alcohol or $C_8$–$C_{22}$ fatty acid or with 1 mol of $C_4$–$C_{12}$ alkylphenol or fatty acid dialkanolamides containing 8 to 22 carbon atoms in the fatty acid moiety.

Alkali metal hydroxides suitable for use as component (d) are sodium hydroxide and, preferably, potassium hydroxide.

Optional component (e) of the detergent composition of this invention is an antifoam based on tributylphosphate or a higher alcohol, for example 2-ethylhexanol or isooctyl alcohol. It is, however, also possible to use antifoams based on silicone oil or alkylenediamines containing amide groups of formula RCONH—, wherein R is an aliphatic or cycloaliphatic radical, for example $C_9$–$C_{23}$ alkyl or cyclohexyl, as well as silicone oils themselves. Further antifoams are disclosed in GB patent specification 1 197 776 or in U.S. Pat. No. 4,767,568.

The wetting agent and detergent composition of this invention comprises with advantage, based on the entire composition, 4–8% by weight of component (a),
5–10% by weight of component (b),
8–15% by weight of component (c),
4–8% by weight of component (d),
0–5% by weight of component (e), and
water to make up 100% by weight.

The novel formulations are especially suitable for use as effective wetting agents and detergent compositions in textile pretreatment.

Accordingly, the present invention also relates to a process for washing and wetting untreated textiles. The process comprises treating these materials, in aqueous medium, in the presence of a novel wetting agent.

The amounts in which the wetting agent and detergent composition is added to the treatment liquors range from 0.1 to 20 g, preferably from 0.5 to 10 g, per liter or treatment liquor. This liquor may contain further ingredients, for example desizing agents, dyes, fluorescent whitening agents, synthetic resins and alkalies such as sodium hydroxide.

Suitable fibre materials are: cellulose, especially non-pretreated natural cellulose such as raw cotton, hemp, linen, jute, and regenerated cellulose such as viscose rayon, viscose staple fibre, acetate rayon, wool, polyamide, polyacrylonitrile or polyester fibre materials and fibre blends, for example polyacrylonitrile/cotton or polyester/cotton blends.

The fibre material to be treated may be in any form of presentation, for example the cellulosic material in the form of open fabric, yarn, woven or knitted fabrics. The material will usually be in the form of textile fibre materials which are made from pure textile cellulosic fibres or from blends of textile cellulosic fibres with synthetic textile fibres or from blends of textile cellulosic fibres and synthetic textile fibres. The fibre material can be treated continuously or batchwise in an aqueous liquor.

The aqueous treatment liquors can be applied in known manner to the fibre materials, conveniently by impregnating on a pad to a pick-up of ca. 50 to 120% by weight. The pad process used will preferably be the pad-steam method as well as the pad-batch method.

Impregnation can be effected in the temperature range from 20° to 60° C., preferably at room temperature. After impregnation, the cellulosic material is subjected to a heat treatment direct, i.e. without first being dried, by steaming in the temperature range from 95° to 120° C., preferably from 98° to 106° C., which treatment may take from 30 seconds to 40 minutes, in accordance with the nature of the heat development and the temperature range. In the pad-batch method, the impregnated goods are rolled up without being dried and subsequently packed in a plastic sheet and stored for 1 to 24 hours at room temperature.

The treatment of the fibre materials may also, however, be carried out in long liquors at a liquor to goods ratio of, for example, 1:3 to 1:100, preferably 1:8 to 1:25, and in the temperature range from 20° to 100° C., preferably from 80° to 98° C., for ca. ¼ hour to 3 hours under normal conditions, i.e. under atmospheric pressure in conventional apparatus, for example a jigger, a winch beck or a jet. If desired, however, the treatment may also be carried out in the temperature range up to 150° C., preferably from 105° to 140° C., under pressure in high-temperature (HT) apparatus.

If the process requires it, the fibre materials are subsequently thoroughly rinsed with hot water of ca. 90° to 98° C. and then with warm and finally with cold water, neutralised, and then hydroextracted preferably at elevated temperature and dried.

Material advantages of the textile assistants of this invention are, in addition to their excellent wetting action, their good hard water resistance and low foaming tendency in use.

In the following Examples, percentages are by weight throughout.

Preparation of the formulations 113 g of a 50% aqueous solution of potassium hydroxide in 239 g of deionised water are charged at a stirring rate of 60 rpm to a ground glass flask of 1500 ml capacity fitted with an anchor agitator. In this solution, 157 g of the mixture of oligomers of formula (2), wherein $R_2$ is methyl, are partially neutralised, whereupon the temperature rises to ca. 55° C. Then 315 g of a 25% aqueous formulation of the polymerisation product of the polyadduct of 1 mol of a $C_{13}$ oxoalcohol with 9 mol of ethylene oxide and 1 mol of acrylic acid, 126 g of the polyadduct of 4 mol of ethylene oxide with 1 mol of a $C_9$–$C_{11}$ fatty alcohol, and 50 g of an antifoam based on 2-ethylhexanol and silicone oil are slowly stirred in, in succession. A pourable, milky formulation with a pH of 4.5 is obtained.

EXAMPLE 2

113 g of a 50% solution of potassium hydroxide in 284 g of deionised water are charged to an apparatus as described in Example 1. In this solution, 157 g of the mixture of oligomers of formula (2), wherein $R_2$ is methyl, are partially neutralised, whereupon the temperature rises to 55° C. Then 315 g of a 25% aqueous formulation of a polymerisation product of the polyadduct of 1 mol of a $C_{13}$ oxoalcohol with 9 mol of ethylene oxide and 1 mol of acrylic acid, 125 g of the polyadduct of 4 mol of ethylene oxide with 1 mol of a $C_9$–$C_{11}$ fatty alcohol, and 5 g of a silicone oil formulation are slowly stirred in, in succession. A pourable, milky formulation with a pH of 4.5 is obtained.

EXAMPLE 3

113 g of a 50% aqueous solution of potassium hydroxide in 284 g of deionised water are charged to an apparatus as described in Example 1. In this solution, 157 g of the mixture of oligomers of formula (2), wherein $R_2$ is methyl, are partially neutralised, whereupon the temperature rises to ca. 55° C. Then 315 g of a 25% aqueous formulation of a polymerisation product of the polyadduct of 1 mol of a $C_{13}$ oxoalcohol with 9 mol of ethylene oxide and 1 mol of acrylic acid, 126 g of the polyadduct of 5 mol of ethylene oxide with 1 mol of isotridecyl alcohol, and 5 g of a silicone oil formulation are slowly stirred in, in succession. A pourable, milky formulation with a pH of 4.5 is obtained.

EXAMPLE 4

113 g of a 50% solution of potassium hydroxide in 239 g of deionised water are charged to an apparatus as described in Example 1. In this solution, 157 g of a mixture of oligomers of formula (2), wherein $R_2$ is methyl, and for 30% of the mixture $2 \leqq m_2 \leqq 13$ and for 70% of the mixture $m_2 = 1$, are partially neutralised, whereupon the temperature rises to ca. 60° C. Then 315 g of a 25% aqueous formulation of a polymerisation product of the polyadduct of 1 mol $C_{13}$ oxoalcohol with 9 mol of ethylene oxide and 1 mol of acrylic acid, 126 g of the polyadduct of 4 mol of ethylene oxide with 1 mol of a $C_9$–$C_{11}$ fatty alcohol, and 50 g of an antifoam based on 2-ethylhexanol and silicone oil are slowly stirred in, in succession. A pourable, milky formulation with a pH of 4.5 is obtained.

EXAMPLE 5

The procedure of Example 1 is repeated, charging a solution of potassium hydroxide in 189 g of water to the apparatus and using, as antifoam, 100 g of a defoamer consisting of 1.65 g of N,N'-ethylene bis(stearamide), 2 g of magnesium stearate, 37 g of bis(2-ethylhexyl)maleate, 37.35 g of paraffin oil (Shelloil L 6189), 11 g of a nonionic emulsifier, for example Tween 65 ® and 11 g of an anionic emusifier, for example Phospholan PNP9 ®.

EXAMPLE 6

The procedure of Example 5 is repeated, using as antifoam 100 g of a foam inhibitor consisting of 47 g of the copolymer of butyl acrylate and bis(2-ethylhexyl)- maleate 50:50, 39 g of isopalmityl alcohol, 7 g of an ethoxylated polydimethyl siloxane, 3.5 g of the polyadduct of 9 mol of ethylene oxide with 1 mol of styrene oxide and 1 mol of $C_{13}$ oxoalcohol, and 3.5 g of oleic acid.

EXAMPLE 7

113 g of a 50% solution of potassium hydroxide in 289 g of deionised water are charged to an apparatus as described in Example this solution, 157 g of a mixture of oligomers of formula (2), wherein $R_2$ is methyl, are partially neutralised, whereupon the temperature rises to ca. 50° C. Then 315 g of a 25% aqueous formulation of a polymerisation product of the polyadduct of 1 mol of a $C_{13}$ oxoalcohol with 9 mol of ethylene oxide and 1 mol of acrylic acid, 126 g of the polyadduct of 4 mol of ethylene oxide with 1 mol of a $C_9$–$C_{11}$ fatty alcohol are slowly stirred in, in succession. A pourable, milky formulation with a pH of 4.5 is obtained.

USE EXAMPLES

EXAMPLE 1

The detergent and wetting agent formulations prepared in accordance with Examples 1 to 3 are tested for their detergent properties in comparison with a detergent which does not contain components (a) and (e) of the formulations of this invention.

The test is carried out by washing a polyester/cotton blend, which has been artificially soiled with soot and engine oil, in an AHIBA dyeing machine with twist for 30 minutes at 40° C. and at a liquor to goods ratio of 1:25. The amount of each detergent composition used is 1 g/l. The pH is adjusted to 10 with sodium hydroxide solution. The water hardness is 0° and 10° dH (German hardness).

Upon termination of the washing, the fabrics are individually rinsed, hydroextracted and dried.

The determination of the colour difference according to DIN 6174 between the washed and non-washed sample is then made. The non-washed sample is given the reflectance number 0. The higher the reflectance number, the better the detergent action.

The results reported in the following Table show that a markedly better detergent action is achieved with the formulations of the invention using hard water (10°) than with the comparison detergent.

| Reflectance number | 0° dH | 10° dH |
|---|---|---|
| formulation according to Example 1 | 24.1 | 20.8 |
| formulation according to Example 2 | 23.1 | 25.1 |
| formulation according to Example 3 | 23.0 | 21.6 |
| comparison detergent | 24.1 | 4.5 |

EXAMPLE 2

The formulations prepared according to Examples 1–3 are tested for their foaming behaviour in comparison with a detergent that does not contain components (a) and (e) of the formulations of this invention. The test is carried out by diluting 1 g of active substance of each of the formulations prepared according to Examples 1–3 to 1 liter with deionised water and adjusting the pH to 10 with sodium hydroxide solution. The formulations are then tested for their foaming behaviour in relation to the comparison detergent composition in accordance with DIN 53 902 (beating method).

The results set forth in the Table below indicate that the formulations of this invention have a significantly better foaming behaviour than the comparison detergent composition.

| foam height (ml) | immediately | after 1 minute |
|---|---|---|
| comparison detergent | 500 | 480 |
| formulation according to Example 1 | 70 | 60 |
| formulation according to Example 2 | 70 | 60 |
| formulation according to Example 3 | 30 | 20 |

EXAMPLE 3

An untreated cotton fabric of 250 g/m² is impregnated with the following formulation:

10 g/l of the formulation according to Example 1

60 g/l of solid sodium hydroxide.

The pick-up is 90%. After this treatment, the goods are steamed for 10 minutes with saturated steam at 101° C., rinsed with hot and cold water, neutralised and dried. The detergent effect is determined by measuring the degree of whitness (CIBA-GEIGY Whiteness Scale).

The untreated material has a degree of whiteness of −65, whereas the treated material has a degree of whiteness of 10.

EXAMPLE 4

A cotton/polyester blend (67/33) of 200 g/m² is selectively soiled with loom lubricating oil and treated (aged) for 1 hour at 100° C. The stained fabric is then washed for 30 minutes at 60° C. in a washing liquor which contains 10 g/l of the formulation according to Example 1 and is adjusted to pH 10, and subsequently dried. The oil stain applied to the fabric and heat-aged is completely removed after the washing.

What is claimed is:

1. An aqueous, hard water-resistant wetting agent and detergent composition which comprises (a) 4–8% by weight of a mixture of monomers and oligomers of formula

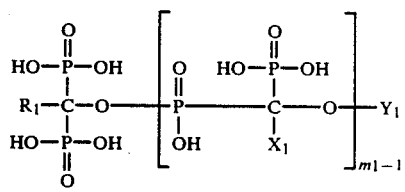

(1)

wherein $Y_1$ is hydrogen or —CO—$T_1$, $R_1$, $X_1$ and $T_1$ are each $C_1$–$C_4$ alkyl, and $m_1$ is an integer from 1 to 17, (b) 5–10% by weight of a water-soluble or water dispersible copolymer which contains not less than 20% by weight, based on said copolymer, of a hydrophilic component which is attached to a carbon atom and at least one hydrophobic radical which is attached through a polyglycol ether chain to the hydrophilic component, which polyglycol ether chain contains 2 to 200

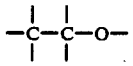

groups, (c) 8–15% by weight of a nonionic surfactant which is a polyadduct of 2 to 200 moles of alkylene oxide with one mole of a $C_8$–$C_{22}$ monoalcohol or a polyadduct of 2 to 200 moles of alkylene oxide with one mole of a $C_8$–$C_{22}$ monoalcohol and one mole of styrene oxide, (d) 4–8% by weight of an alkali metal hydroxide, (e) 0–5% by weight of an antifoam, and water to make 100% by weight.

2. A composition according to claim 1, wherein component (a) is a mixture of monomers and oligomers of formula

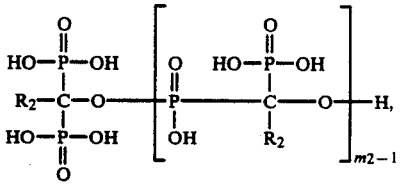

(2)

wherein $R_2$ is methyl or ethyl and $m_2$ is a number from 1 to 13.

3. A composition according to claim 1, wherein component (a) is a monomer of formula

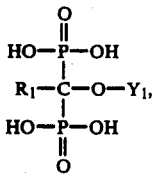

(3)

wherein $Y_1$ is hydrogen or —CO—$T_1$, and $R_1$ and $T_1$ are each $C_1$–$C_4$ alkyl.

4. A composition according to claim 3, wherein component (a) is a monomer of formula

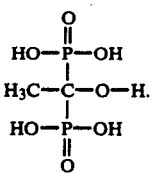

(4)

5. A composition according to claim 1, wherein component (b) is a graft polymer which contains in the main chain the radical of an anionic, cationic, amphoteric or nonionic alkylene oxide polyadduct which carries a hydrophobic radical, and which contains side-chains of structural units grafted on to individual carbon atoms of said main chain, which structural units are derived from an ethylenically unsaturated polymerisable sulfonic acid or carboxylic acid or an anhydride thereof.

6. A composition according to claim 5, wherein the main chain consists of a radical of a polyadduct of 2 to 200 mol of alkylene oxide with 1 mol of an aliphatic monoalcohol containing not less than 8 carbon atoms, of a trihydric to hexahydric aliphatic alcohol or of a $C_8$–$C_{22}$ fatty acid.

7. A composition according to claim 5, wherein the main chain consists of a radical of a polyadduct of 2 to 40 mol of ethylene oxide with 1 mol of a $C_{12}$–$C_{22}$ fatty alcohol.

8. A composition according to claim 5, wherein component (b) contains monocarboxylic acids of 3 to 5 carbon atoms as grafted monomers in the side-chains.

9. A composition according to claim 8, wherein component (b) contains acrylic acid as grafted monomer in the side-chains.

10. A composition according to claim 1, which contains potassium hydroxide as component (d).

11. A process for washing untreated textiles, which comprises treating said textiles, in the presence of a composition which comprises (a) 4–8% by weight of a mixture of monomers and oligomers of formula

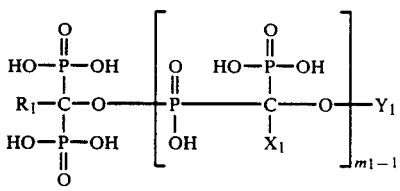

(1)

wherein $Y_1$ is hydrogen or —CO—$T_1$, $R_1$, $X_1$ and $T_1$ are each $C_1$–$C_4$ alkyl, and $m_1$ is an integer from 1 to 17, (b) 5–10% by weight of a water-soluble or water-dispersible copolymer which contains not less than 20% by weight, based on said copolymer, of a hydrophilic component which is attached to a carbon atom and at least one hydrophobic radical which is attached through a polyglycol ether chain to the hydrophilic component, which polyglycol ether chain contains 2 to 200

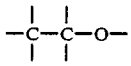

groups, (c) 8–15% by weight of a nonionic surfactant which is a polyadduct of 2 to 200 moles of alkylene oxide with one mole of a $C_8$–$C_{22}$ monoalcohol or a polyadduct of 2 to 200 moles of alkylene oxide with one mole of a $C_8$–$C_{22}$ monoalcohol and one mole of styrene oxide, (d) 4–8% by weight of an alkali metal hydroxide, (e) 0–5% by weight of an antifoam, and water to make 100% by weight.

12. A process according to claim 11, wherein the composition is used in an amount of 0.1 to 20 g, preferably 0.5 to 10 g, per liter of liquor.

* * * * *